US008650784B2

(12) United States Patent
Halfen et al.

(10) Patent No.: US 8,650,784 B2
(45) Date of Patent: Feb. 18, 2014

(54) FILE FOLDER AND REPOSITIONABLE TAB

(75) Inventors: Marvin Halfen, Hastings, MN (US); David J. Gilbertson, Hastings, MN (US)

(73) Assignee: Smead Manufacturing Company, Hastings, MN (US)

( * ) Notice: Subject to any disclaimer, the term of this patent is extended or adjusted under 35 U.S.C. 154(b) by 351 days.

(21) Appl. No.: 12/956,489

(22) Filed: Nov. 30, 2010

(65) Prior Publication Data

US 2011/0127317 A1 Jun. 2, 2011

Related U.S. Application Data

(60) Provisional application No. 61/264,943, filed on Nov. 30, 2009, provisional application No. 61/289,644, filed on Dec. 23, 2009.

(51) Int. Cl.

| | |
|---|---|
| ***G09F 23/10*** | (2006.01) |
| ***B42F 21/00*** | (2006.01) |
| ***B65D 27/00*** | (2006.01) |
| ***G09F 3/00*** | (2006.01) |

(52) U.S. Cl.
USPC ..... 40/641; 40/360; 40/323; D19/99; 229/67.2; 283/36

(58) Field of Classification Search
USPC ..... 229/67.2; 283/36; 40/641, 360, 323
See application file for complete search history.

(56) References Cited

U.S. PATENT DOCUMENTS

| | | | | | |
|---|---|---|---|---|---|
| 2,357,070 | A * | 8/1944 | Bates | 40/359 |
| 2,362,445 | A * | 11/1944 | Blodgett | 24/710.8 |
| 2,633,849 | A * | 4/1953 | Daniel et al. | 40/360 |
| 2,664,089 | A * | 12/1953 | Meltzer | 40/651 |
| 2,815,595 | A * | 12/1957 | Davis | 40/641 |
| 3,062,217 | A * | 11/1962 | Woodhouse, Jr. | 40/652 |
| 3,073,046 | A * | 1/1963 | Condon | 40/641 |
| 3,204,639 | A * | 9/1965 | Kleffman | 40/360 |
| 3,248,814 | A * | 5/1966 | Zwolinski et al. | 40/641 |
| 4,582,987 | A * | 4/1986 | Bianco | 235/486 |
| 4,660,855 | A * | 4/1987 | Pagliaccio | 281/2 |
| 6,332,285 | B1 * | 12/2001 | Aaldenberg et al. | 40/641 |
| 7,610,707 | B1 * | 11/2009 | Payne | 40/641 |
| 2008/0197176 | A1 * | 8/2008 | DeCarlo et al. | 229/67.2 |

* cited by examiner

*Primary Examiner* — Nathan J Newhouse
*Assistant Examiner* — Derek Battisti
(74) *Attorney, Agent, or Firm* — Altera Law Group, LLC

(57) ABSTRACT

The folder is formed from a single sheet, folded along a fold line to form opposing walls. Each wall, at its top, includes a retaining portion that folds over a metal or plastic channel rod and includes a series of horizontally-spaced holes. The holes extend vertically over the lower edge or a rib of the channel rod. Each channel rod extends laterally past the edge of the folder and includes notches or hook ends that engage a pair of rails. Each tab includes a clip portion that opens downward. The clip portion includes two vertically-oriented inner faces, one or both of which includes inward-facing dimples or protrusions that fit at least partially into the holes in the retaining portion. At least one optional protrusion may be locating, meaning that the top of the protrusion does not engage the channel rod when the tab is fully attached.

10 Claims, 15 Drawing Sheets

FILE FOLDER AND REPOSITIONABLE TAB

CROSS-REFERENCE TO RELATED APPLICATIONS

This application claims the benefit of U.S. Provisional Application No. 61/264,943 filed 30 Nov. 2009, and claims the benefit of U.S. Provisional Application No. 61/289,644 filed 23 Dec. 2009, which hereby are incorporated herein by reference in its entirety.

BACKGROUND OF THE INVENTION

1. Field of the Invention

The present invention is directed primarily to hanging file folders with repositionable tabs.

2. Description of the Related Art

Hanging file folders with repositionable tabs are relatively commonplace in most offices. In a typical hanging file folder, each end of the paper folder material is folded over a metal channel rod and glued in place. The two metal channel rods protrude laterally from the sides of the folder and rest on supporting end rails. The tabs are attached to the folder at holes along the folded-over portion of the folder. Typical tabs have flexible plastic "wings" on each lateral side, which may be bent and inserted through respective holes in the folded-over portion. The tabs may be removed and repositioned among the various holes along the folded-over paper portion. Users want to reposition the tabs so that they easily viewable. If they are positioned offset from each other in a cascading stair-step arrangement, then many file tabs will be viewable at the same time.

One potential drawback of the typical hanging file folders is that the repositionable tabs are supported only by the folder paper material, and are therefore relatively fragile. Another potential drawback is that the tag must be removed to reposition it to a new location along the rod. This is considered quite inconvenient, as it is a frequent occurrence with users who want to keep their tabs in a cascading order for easy viewing.

Accordingly, there exists a need for a hanging file folder with repositionable tabs that more sturdily supports the tabs.

BRIEF SUMMARY OF THE INVENTION

An embodiment is a repositionable tab attachable to a top edge of a hanging file folder, the folder having two opposing walls supported at their top edges by respective channel rods, at least one wall having a plurality of vertically-oriented apertures adjacent its top edge facing the opposing wall, the apertures being spaced horizontally apart with a regular spacing, comprising: a downward-opening clip portion, the clip portion having a top edge that contacts a top edge of a wall of the hanging file folder when the tab is fully attached, the clip portion having two vertically-oriented inner faces that are on opposite sides of the wall when the tab is fully attached, the two inner faces including a pair of first and second spaced apart collinear protrusions aligned to face each other and face the apertures on the wall when the tab is fully attached, the protrusions extending toward the wall, the protrusions being spaced horizontally apart by an integral multiple of the aperture spacing on the wall, the protrusions fitting at least partially within corresponding apertures on the wall when the tab is attached, the protrusions engaging the channel rod when the tab is fully attached; a third bias protrusion located between said first and second protrusions, but not collinear therewith, the third protrusion located relative to said first and second protrusions to engage said rod when the tab is fully attached. The third protrusion will apply a bias force between said rod and tab to maintain the position of the tab.

Another embodiment is a file folder assembly for suspension in a filing unit with two spaced-apart suspension rails, said file folder assembly comprising: a sheet folded along at least one medial line to define a folder having opposing walls extending upwardly from said at least one medial line, each wall having an upper edge and two side edges, each wall including a retaining portion at the upper edge thereof, each retaining portion surrounding a channel rod, each channel rod extending laterally beyond the side edges adjacent the upper edge, each channel rod including notches at its lateral or distal ends for engaging the spaced-apart suspension rails, each retaining portion including a plurality of vertically-oriented apertures facing the opposing wall, the apertures being spaced horizontally apart with a regular spacing, each vertically-oriented aperture extending across a lower edge of the channel rod; and a repositionable tab attachable to the top of each retaining portion, each tab including a downward-opening clip portion, the clip portion having a top edge that contacts a top edge of the retaining portion when the tab is fully attached, the clip portion having two vertically-oriented inner faces that are on opposite sides of the retaining portion when the tab is fully attached, the two inner faces comprising a dimpled face that faces the apertures on the retaining portion when the tab is fully attached; the dimpled face including at least first and second locking protrusions extending toward the retaining portion, the locking protrusions being spaced horizontally apart by an integral multiple of the aperture spacing on the retaining portion, the locking protrusions fitting at least partially within corresponding apertures in the retaining portion when the tab is attached, the locking protrusions engaging the channel rod when the tab is fully attached.

A further embodiment is a method of removeably securing a tab on the top edge of a hanging folder, the folder having a plurality of spaced apart slots adjacent a support rod, the method comprising the steps of: (a) forming a tab having an upper portion for holding indicia; (b) forming a lower portion of two spaced apart faces thereby creating a gap therebetween, the gap being roughly the thickness of the hanging folder at its top edge; (c) forming a pair of spaced apart collinear protrusions in each face, the protrusions facing each other inwardly into the gap, said protrusions being formed at a vertical position on the tab so that they will engage the folder below the rod when the tab is installed on the folder; and (d) forming a third bias locking protrusion on each face, and facing each other into said gap, said third protrusion being located to engage said rod when the tab is installed on the folder, thereby creating a bias force between the rod and the tab to prevent accidental movement thereof.

DETAILED DESCRIPTION OF THE INVENTION

A hanging file folder and repositionable tab are disclosed. In one embodiment, the folder is formed from a single sheet, folded along a fold line to form opposing walls. Each wall, at its top, includes a retaining portion that folds over a metal or plastic channel rod and includes a series of horizontally-spaced holes. The holes extend vertically over the lower edge or a rib of the channel rod. Each channel rod extends laterally past the edge of the folder and includes notches that engage a pair of rails. Unlike known tabs that rely on the folder paper material for strength, the tab disclosed herein directly engages the channel rod for strength. Each tab includes a clip portion that opens downward. The clip portion includes a top edge that contacts the top edge of the wall when the tab is fully attached. The clip portion includes two vertically-oriented inner faces, one or both of which includes at least two inward-facing dimples or protrusions that fit at least partially into the holes in the retaining portion. The protrusions may be locking, meaning that the top of the protrusion engages the lower edge or a rib of the channel rod when the tab is fully attached. At least one optional protrusion may be locating, meaning that the top of the protrusion does not engage the channel rod when the tab is fully attached. Other embodiments are also disclosed. The previous paragraph is merely a summary, and should not be construed as limiting in any way. A more detailed discussion follows.

Figure 1:
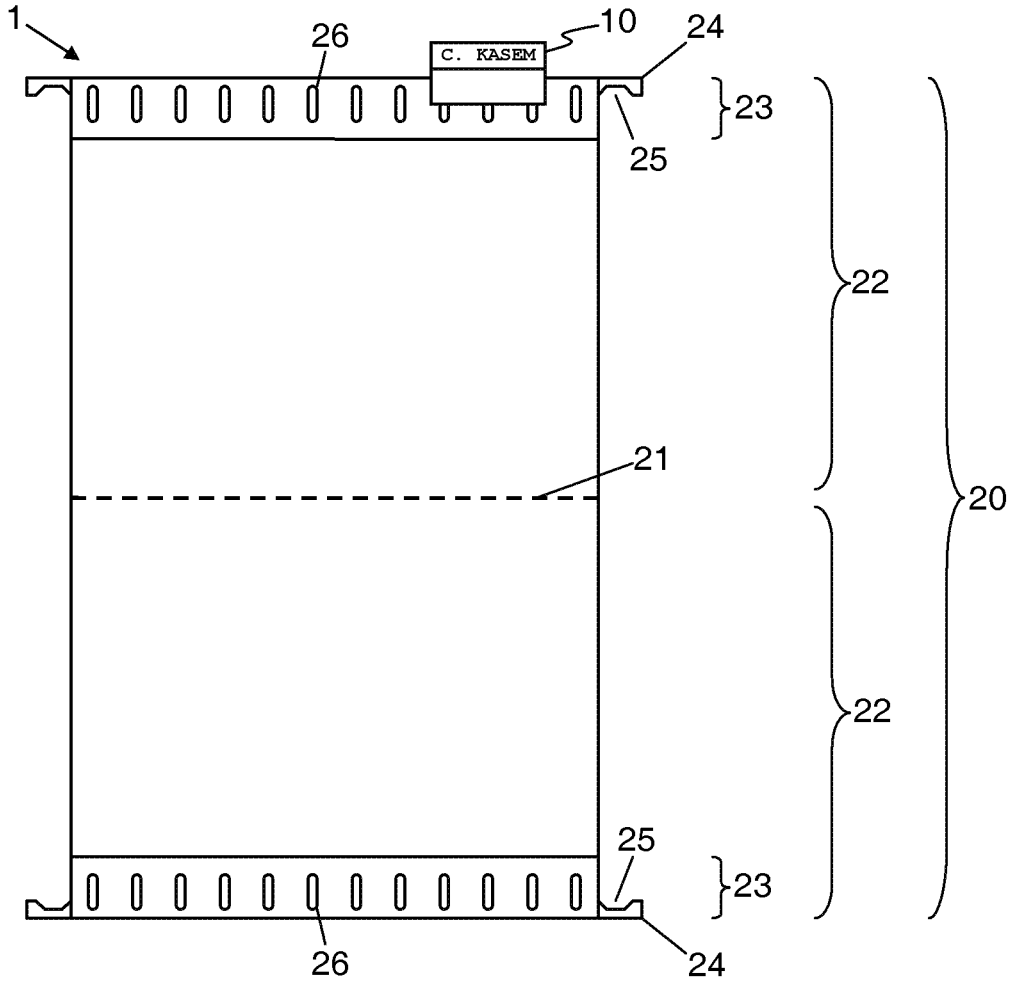
FIG. 1 is a schematic drawing of an unfolded file folder with a repositionable tab.

FIG. 1 is a schematic drawing of a file system 1, including an unfolded file folder 20 with a repositionable tab 10. The tab 10 is described in much greater detail below, following a brief description of the file folder 20.

The hanging file folder 20 is generally formed as a single sheet of material, usually paper or plastic. The sheet is folded along one or more medial or fold lines 21. For a thin bundle of papers to be stored in the folder, a single fold line 21 may be sufficient. However, for a relatively thick bundle of papers, folding the sheet along only one fold line may cause the front and/or back walls 22 to bend, which may be undesirable. In these cases, there may be multiple fold lines in the sheet, which are parallel and are spaced apart by a few millimeters. The multiple fold lines allow for a thick bundle of papers to be stored in the folder, while maintaining parallel front and back walls 22. It will be understood that the single fold line 21 may be replaced with multiple fold lines as necessary.

The folder 20 is shown in its unfolded state in FIG. 1. In practice, the folder is folded along the medial line 21, and the two walls 22 face each other on the inside of the folder. Walls 22 are typically the paper material which makes up folder and which is wrapped around the support bar 24. The medial line 21 is at the bottom edge of the folder when the folder is hanging.

Figure 5:
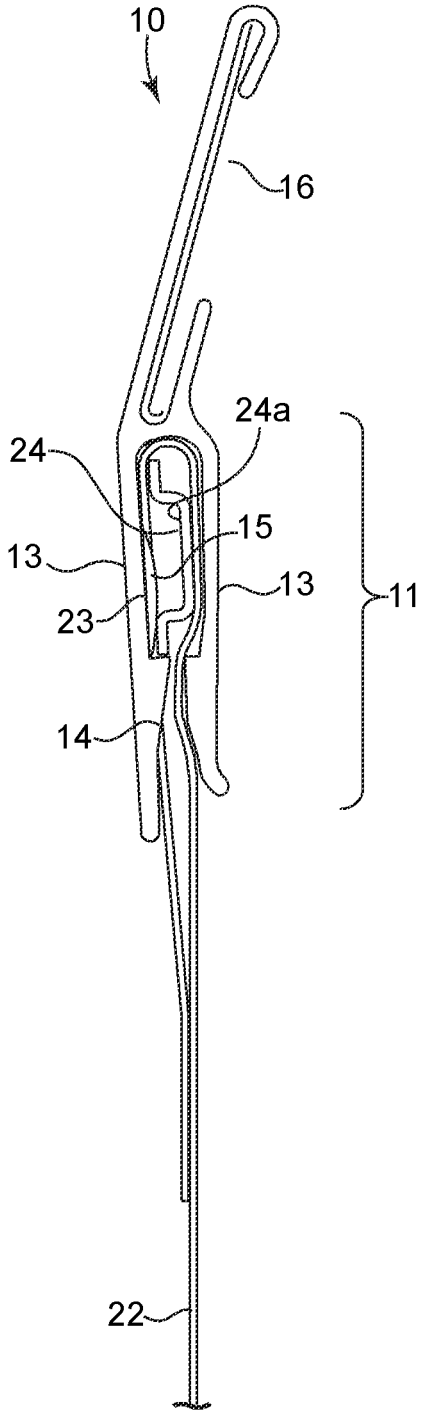
FIG. 5 is a side-view cross-sectional drawing of the repositionable tab of FIGS. 2-4, with the cross-section taken through one of the outer locking protrusions and including an upper portion of the folder.

At the upper edge of each wall 22 is a retaining portion 23, which is typically formed by folding the sheet over a channel rod/bar 24 and attaching it to itself. The rod is of type known in the art and include a trough 24*a*, though the trough can be a flat rod with periodic depressions or apertures. It may also be a plain flat rod/bar or round. The attachment is usually with glue or other suitable adhesive. The channel rod 24 is typically a metal strip, although plastic or other suitable rigid material may be used. The ends of the channel rods extend laterally outward beyond the side edges of the walls 22. The channel rods 24 include hooks/notches 25 at their lateral ends, which can engage a pair of spaced-apart suspension rails. In other words, for a set of parallel rails in a drawer, the channel rod 24 rests on the rails, with each notch 25 engaging one of the rails. The two channel rods 24 support the folder 20. Channel rod 24 may be of the flat kind known in the prior art, or a channel version, also known in the prior art, but heretofore not used for this purpose. The channel rod shown in FIG. 5 illustrates a recess or channel (indicated with 24*a*) and having two flanges. The recess and flanges provide strength, but the recess also cooperates to provide a system for securing the slideable tab as will be explained below.

The retaining portion 26 includes a series of regularly spaced holes, slots or apertures 26. The holes 26 are typically elongated in the vertical direction, and are spaced horizontally apart from each other. These slot 26 allow the protrusions 14*a*/15 to engage/disengage the rail when slid orthogonally thereto The spacing is typically one inch (25 mm), although any suitable spacing may be used. In the preferred embodiment the spacing corresponds to prior art standard tab spacing so that the hanging folder is backwards-compatible.

Each aperture 26 extends across a lower edge of the channel rod 24. In other words, at the top of each aperture 26, a portion of the channel rod is exposed. Farther down in the aperture 26, the lower edge of the channel rod 24 is exposed. At the bottom of each aperture 26, the back face of the retaining portion 23 is exposed.

Figure 7:
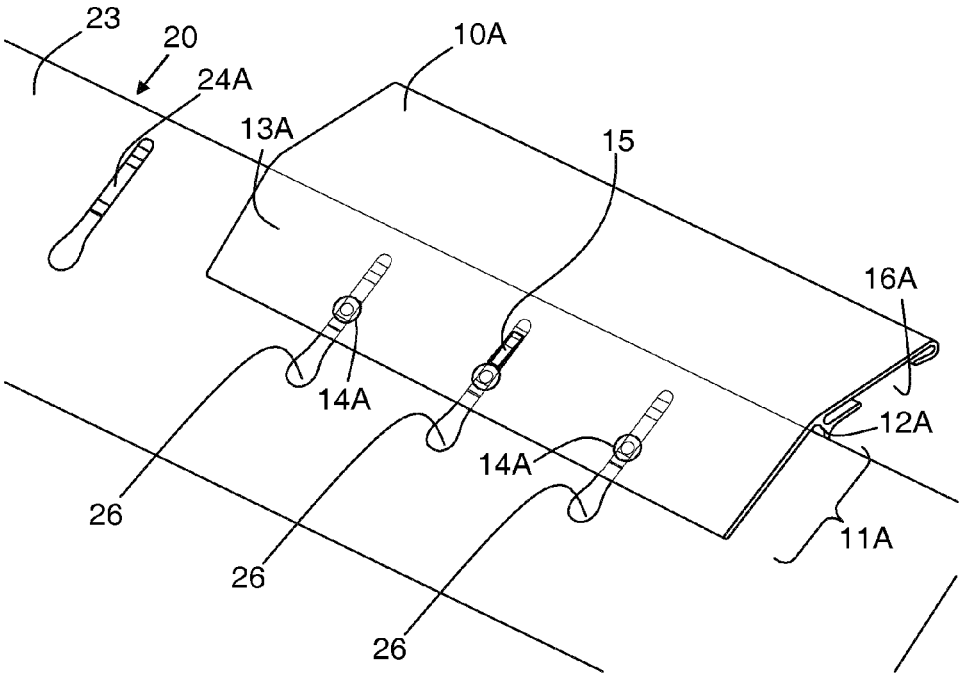
FIG. 7 is a plan drawing of another exemplary repositionable tab, attached to the top of a folder.

The repositionable tab 10 is attachable to the top edge of the retaining portion 23, and engages at least two of the holes 26 in the retaining portion, though the preferred embodiment uses three such holes (see FIG. 7). The tab 10 may be removed and reattached to any of the holes along the retaining portion, between the left and right edges of the wall 22.

One type of known repositionable tab includes a pair of laterally extending plastic "wings", each of which may be inserted into a respective hole 26 in the retaining portion 23 of the folder 20. A drawback to this style of known tabs is that the strength of the tab depends on the strength of the paper material used to form the retaining portion 23. In general, the paper is not strong or rigid, and this style of known tab may be torn loose relatively easily.

The repositionable tab 10 disclosed herein, and shown in FIGS. 2-6, overcomes the drawback of the known tabs by using the channel rod 24 for support. Specifically, the tab 10 includes dimples or protrusions that engage the lower edge of the channel rod 24 when the tab 10 is fully attached.

Figure 2:
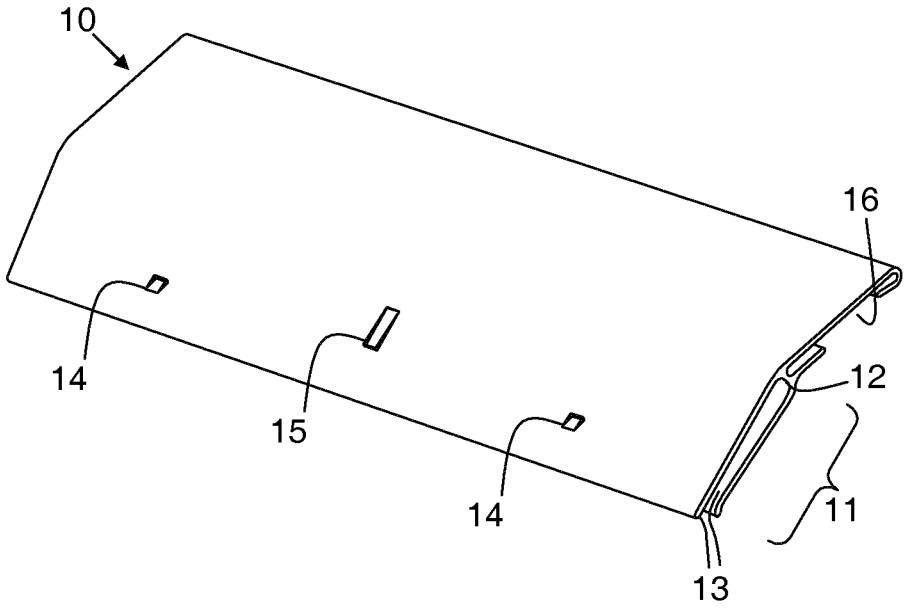
FIG. 2 is a plan drawing of an exemplary repositionable tab.

FIG. 2 is a plan drawing of an exemplary repositionable tab 10.

The tab 10 includes an upper portion 16 that extends above the file folder. This upper portion 16 is typically transparent, although it may optionally be tinted a particular color or may include a partially transparent design. The upper portion includes a slot that can accommodate a name tag, or other paper card that can include indicia of any suitable type.

The lower portion of the tab 10 attaches to the top of the folder wall 22, and includes a so-called "clip portion" 11 that opens downward. The clip portion 11 has two inner faces 13, which are generally vertical and face each other, and a top edge 12 that joins the two inner faces 13. The top edge 12 contacts a top edge of the wall 22 when the tab 10 is fully attached. The two inner faces 13 clip onto the top edge of the retaining portion 23, so that they are on opposite sides of the wall 22 when the tab is fully attached.

One or both of the inner faces 13 includes two or more dimples or protrusions that extend inward, toward the center of the clip portion 11. The dimples include two or more locking protrusions 14 and one or more optional locating protrusions 15. The dimples are spaced apart horizontally by an integral multiple of the spacing of the apertures 26 on the wall 22. In the preferred embodiment, the dimple spacing equals the aperture spacing, so that three dimples on the inner face 13 may fit into three adjacent holes 26 in the wall 22, and so forth.

The dimples themselves may be formed as inward bulges to the dimpled inner face, as shown in FIG. 2. Alternatively, the dimples may be formed as local increases in thickness to the dimpled inner face. In both cases, the dimples extend inward, toward the interior of the clip portion 11.

Figure 3:
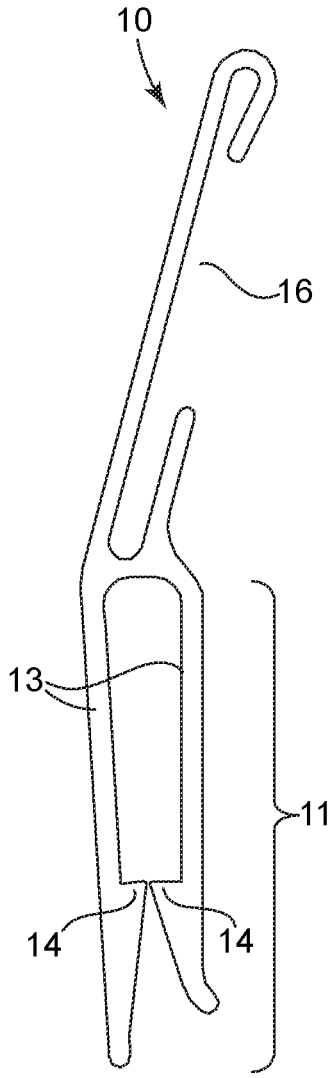
FIG. 3 is a side-view cross-sectional drawing of the repositionable tab of FIG. 2, with the cross-section taken through one of the outer locking protrusions.
Figure 4:
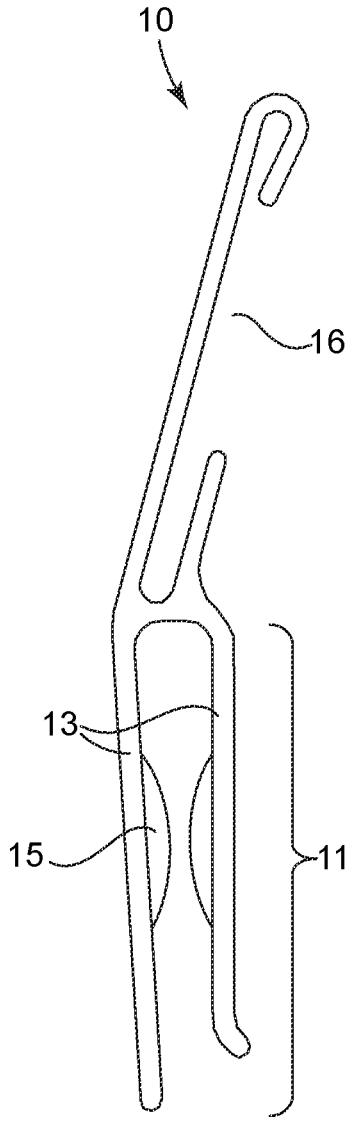
FIG. 4 is a side-view cross-sectional drawing of the repositionable tab of FIGS. 2-3, with the cross-section taken through the middle locating protrusion.

From FIG. 2 alone it may be difficult to see the structure of the dimples, or the difference between the locking protrusions 14 and the locating protrusions 15. The structures and differences are shown more clearly in the side-view cross-sectional drawings of FIGS. 3 and 4. FIG. 3 is a cross-section taken through one of the outer locking protrusions 14. FIG. 4 is a cross-section taken through the middle locating protrusion 15.

First, we examine the locking protrusion 14 of FIG. 3. Note that the locking protrusion 14 includes a ramp on its bottom edge, and no such ramp on its top edge though this can be done in reverse. In other words, the lower edge of the locking protrusion 14 has a gradual transition to the plane of the dimpled face 13, while the upper edge has a more abrupt, rather than gradual sloping characteristic of the entry (lower) ends transition to the plane of the dimpled face 13. Other configurations are possible, such as cylindrical or domed dimples, but the ramp structure is preferred because it assists in insertion. Also in the preferred embodiment, the protrusions 14 are both legs 13 so that they are "back to back". This provides additional pressure on the folder to prevent accidental removal and allows the tab to be used on the front or rear leaf of the folder, since holes 26 are typically provided on both (see FIG. 1).

As the tab 10 is being positioned into place, the user forces the tab 10 downward over the channel rod 24. This force brings the lower ramped portion into contact with the channel rod 24, and forces the locking protrusion 14 outward. When the tab is positioned fully into place, the upper edge of the locking protrusion 14 "snaps" under the lower edge of the channel rod 24. Once the tab 10 is fully attached, the upper edge of the locking protrusion 14 remains under the lower edge of the channel rod 24. Therefore, the channel rod 24 helps support the tab 10 directly, without significantly relying on the strength of the paper material of the retaining portion 23. In the preferred embodiment, it is the interaction between the rod 24 the three protrusions 14 (×2) and 15 which create a bias and torque on the tab which tends to keep it in place. This occurs because protrusion 15 preferably sits atop the flange portion of the rod which applies a bias force therebetween and keeps the tab from sliding or "rattling" from a loose fit, while protrusions 14 keep the tab from jumping out of the holes or be contained vertically, in which they have become engaged. This also constitutes a method of securing a tab to a file folder by use of the bias force between the tab at 15 and the folder (or rod). This method of applying force still allows the tab to be slideable, but against a bias force. If the retaining portion 23 (which can be a paper material wrapped around the support bar 24), has apertures 26 (FIG. 7) it is possible to dispense with recesses or holes in the bar.

The tab 10 is also detachable and repositionable, so the user can pull the tab 10 off the top of the wall 22 without damaging or irreversibly altering either the tab 10 or the folder 20. The locking protrusion 14 may optionally have rounded or sloping edges on its lateral sides (into and out of the plane of FIG. 3), so that the tab 10 may be moved from hole-to-hole without damage. The slope is not shown but would be essentially the same slope as the lower or upper portions of protrusion 14, which are visible in FIG. 4. The abrupt transition on the top edge of the locking protrusion 14 may optionally have a rounded/sloped edge as well.

FIG. 3 shows matching inward-facing protrusions 14 on both inner faces 13 of the tab 10. Such matching protrusions are optional but preferred.

The lateral width of the locking protrusion 14 may be generally comparable to that of the holes 26. In some cases, the locking protrusion 14 fits laterally within the holes 26. In other cases, the locking protrusion 14 is laterally wider than the holes 26, and only the innermost (center) portion of the protrusion 14 fits within the holes 26; in this case, we may refer to the locking protrusions 14 as fitting "at least partially" within the holes 26.

Next, we examine the locating protrusion 15 of FIG. 4. Although it may appear similar to the locking protrusion 14, and may even have an optional corresponding protrusion on the opposite inner face 13, there are differences in construction and function that are noted below.

A difference in construction is that the upper edge of the locating protrusion 15 has the ramp, rather than the lower edge as with the locking protrusion 14. The lower edge of the locating protrusion 15 may optionally have an abrupt transition to the plane of the dimpled face, or may optionally have another ramp. Functionally, the lower edge of the locating protrusion 14 is less important than the upper edge, and therefore its shape may be varied as desired.

Note that the lower edge of the locating protrusion 15 is roughly coincident with the upper edge of the locking protrusions 14. (See FIG. 2.) In any event, while protrusions 14 are preferably co-linear and coplanar, protrusion 15 is not collinear, in-line, with the 14's but located above the line between 14's. This allows protrusions 14 to reside outside of the rod, while 15 will reside on the rod, either on the flange or in the recess or straddling the two. Note also that the ramp on the upper edge of the locating protrusion 15 may extend across the lower edge of the channel rod 24. Protrusion 15 is also preferably longer or taller in the direction orthogonal to the rod. This taller aspect allows 15 to reside on the rod, either on the flange or in the recess or straddling the two. It is possible that protrusions 14 may be coplanar but not collinear, or collinear but not coplanar.

A difference in function is that the locating protrusion 14 is not intended to lock onto the lower edge of the channel rod 24. It is intended that the locating protrusion 14 fits entirely or partially into a hole 26 with or without locking. This helps laterally stabilize the tab 10, and may lock the tab into position to maintain a vertical removal of the tab.

FIG. 5 shows how the channel rod 24 within the wall 22 of the folder 20 interacts with the protrusions. FIG. 5 is a side-view cross-sectional drawing of the repositionable tab 10 of FIGS. 2-4, with the cross-section taken through tab 15 and including an upper portion of the folder 20.

Note that the locking protrusion 14 clamps underneath the lower edge of the channel rod 24, and extends through a hole 26 in the retaining portion 23. It should be noted that the holes 26 generally extend vertically across the lower edge of the channel rod 24. In this case, protrusion 15 is straddling the flange and recess of rod 24. In the preferred embodiment, the "normal" or "fixed" position of tab 10 will have the highest portion of protrusion 15 engaging primarily the flange, so that maximal locking force is applied between the rod and tab.

Figure 6:
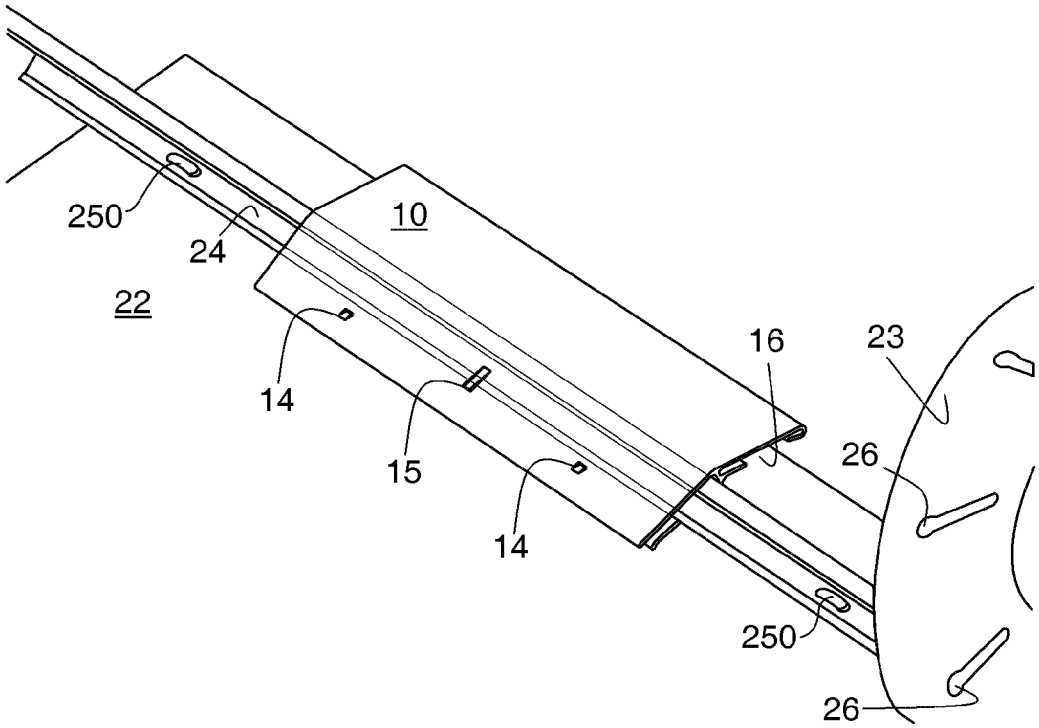
FIG. 6 is a schematic drawing of the exemplary repositionable tab of FIGS. 2-5, attached to the top of a folder, with the retaining portion peeled back.

To make this even clearer, FIG. 6 is a schematic drawing of the exemplary repositionable tab 10 of FIGS. 2-5, attached to the top of a folder wall 22, with the retaining portion 23 peeled back. Notice that the locking system may include a pair of linking protrusions 14 paired with a protrusion 15 on different sides of the trough 24*a* of bar 24. This creates a multi-point lock between the trough 24*a* and the outer edge of the bar 24 creating a tension therebetween resulting from the compressive forces around the bar by the clip portion 11 which has a pair of protrusion supported by spaced apart compressive arms. These arms define a gap smaller than the bar therebetween.

Note that the two outer locking protrusions 14 lie below the lower edge of the channel rod 24, while the locating protrusion 15 extends vertically across the lower edge/flange of the channel rod 24.

FIG. 7 is a plan drawing of another exemplary repositionable tab 10A, attached to the top of a folder 20.

Like the tab 10 of FIGS. 2-6, this tab 10A also has an upper portion 16A, and a clip portion 11A with a top edge 12A and opposing inner faces 13A. At least one of the inner faces 13A is a dimpled face, with two locking protrusions 14A and no locking protrusions.

There are 3 major differences between the tab 10A of FIG. 7 and the tab 10 of FIGS. 2-6.

First, the tab 10A lacks a locating protrusion.

Second, the locking protrusions 14A are shaped as round dimples, compared with the generally vertically oriented protrusions 14 and 15. Here, the locking protrusions are shaped as portions of a sphere, although they may be elongated as desired. Note that the protrusion diameter is larger than the lateral width of the hole 26. In this case, the protrusion 14A fits partially within the hole 26.

Third, the channel rod 24A has one or more ribs, and the locking protrusions 14A engage a rib of the channel rod 24A, rather than the lower edge of the channel rod 24A.

As an example, consider the cross-section of the channel rod 24 shown in FIG. 5. This particular channel rod 24 includes two small ribs/flanges at the top and bottom edges. These ribs are accessible from the right side of the diagram in FIG. 5. If we were to reverse the orientation of the channel rod 24, flipping it left-to-right in FIG. 5, then it would be perfectly acceptable to engage the lower rib/flange in the channel rod, rather than engage the lower trough/recess of the channel rod itself. The tab uses the channel rod for direct support, rather than the paper material of the folder, so the tab is stronger than the typical known tabs that rely on the folder paper for support.

For the specific channel rod 24A shown in FIG. 7, the protrusions engage a lower rib/flange of the channel rod 24A, rather than the channel rod recess.

Figure 8:
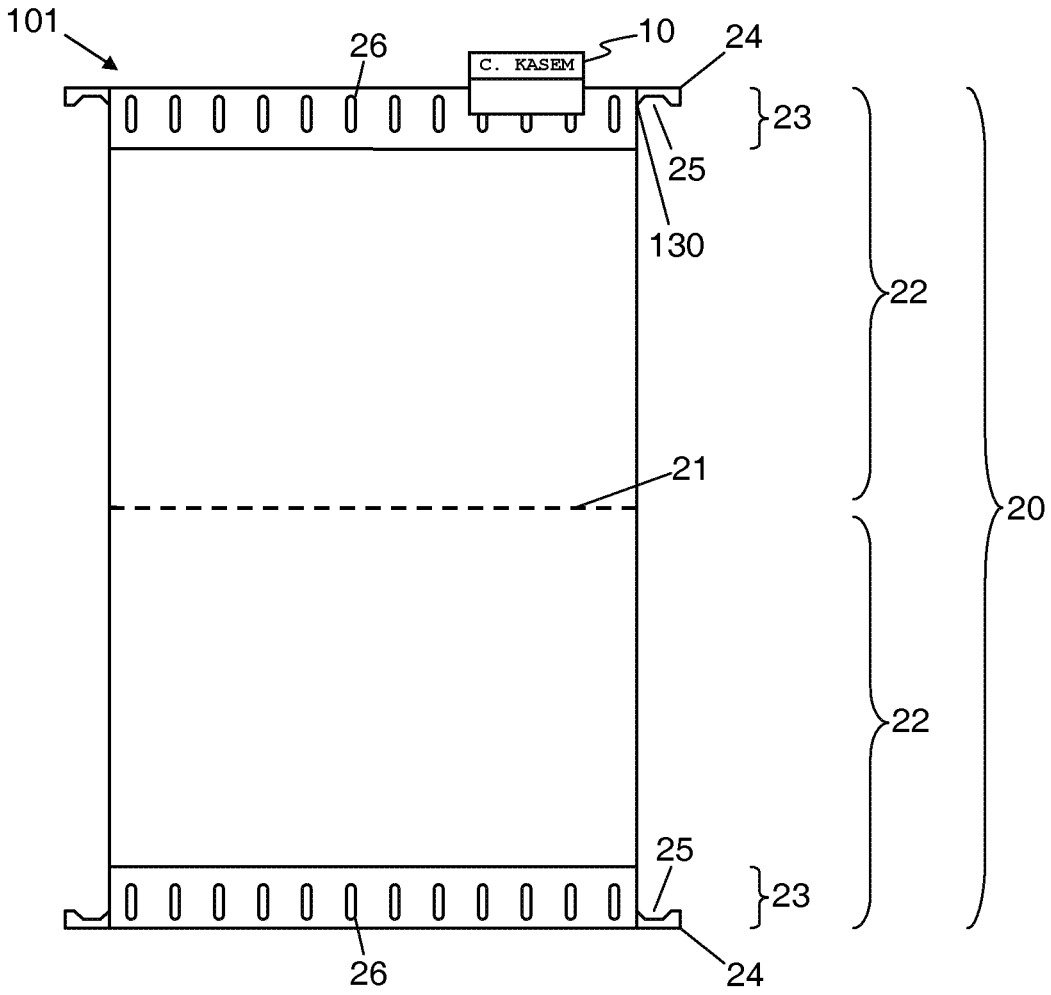
FIG. 8 is a schematic drawing of an unfolded file folder with a repositionable tab, with channel rods having non-angled portions directly adjacent to the folder walls.
Figure 8A:
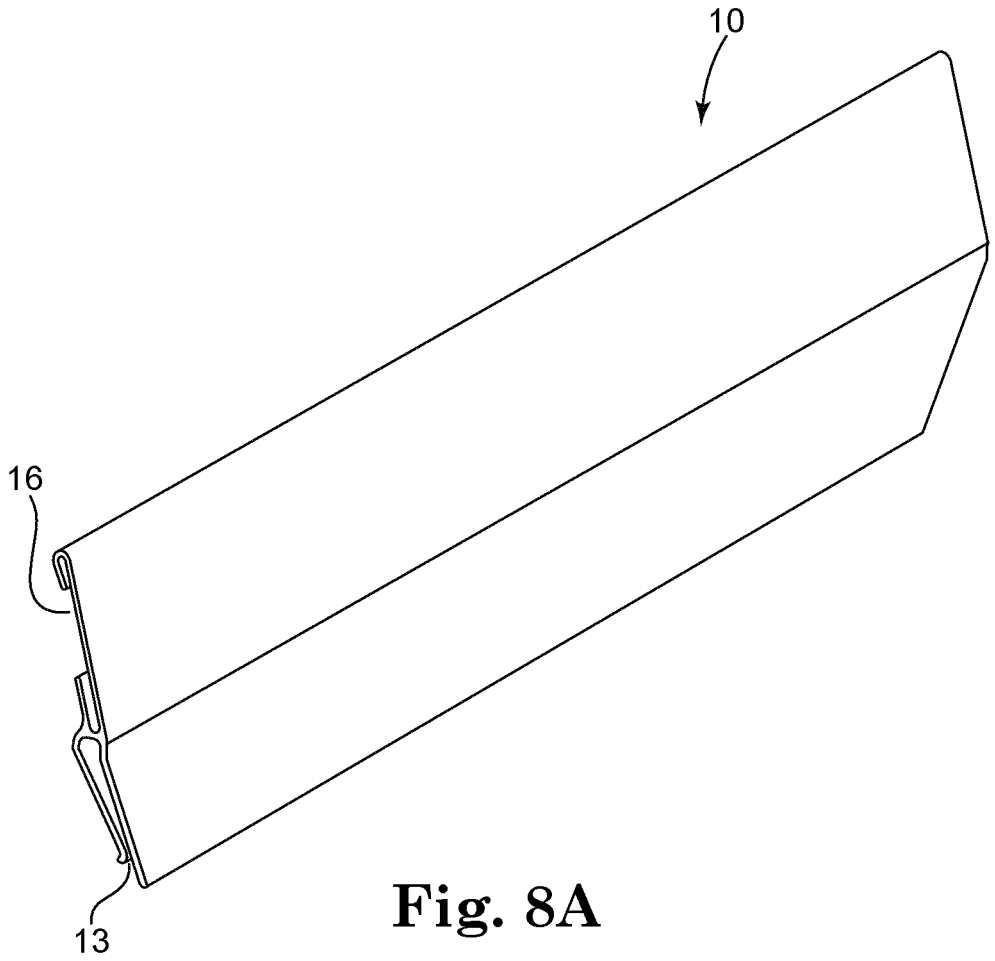
FIG. 8*a* is a view like FIG. 2 from a different perspective and with apertures deleted but having a different display angle.

An alternative design for the file system 101 is shown in FIG. 8. Many of the elements are identical in structure and function to those shown in the designs of FIGS. 1-7; those common elements share common element numbers as well. In particular, the channel rod 124 is reshaped in the regions directly adjacent to the wall of the folder.

A potential drawback of the design of FIG. 1 becomes apparent when the folder is especially full.

As noted above, the channel rods 24 of FIG. 1 include notches or hook ends 25 at their lateral or distal ends, which can engage a pair of spaced-apart suspension rails. In other words, for a set of parallel rails in a drawer, the channel rod 24 rests on the rails, with each notch 25 engaging one of the rails.

The notches or hood ends 25 of FIG. 1 are defined by angled portions 25*a* and 25*b* (see FIG. 9*a*) on either lateral side of the notch, so that if a rail encounters an angled portion during insertion, the angled portion will slide along the rail until the folder comes to rest with the rail being within the notch 25. Such angled portions are especially handy when the folders are empty or nearly empty.

However, when the folder is filled or over-filled, one or both of the angled portions may pose a potential problem for the folder. When the folder is full, the two channel rods are appreciably separated when the folder is hanging, and become angled or splayed so that the support rods begin to form an arcuate shape. This can lead to two undesirable results: First, the rods may collapse when bent because they are not as rigid and two, the rods tend to separation from their retaining portion/overlay 23. Once separation begins, it often leads to complete separation. When viewed from the side, the folder makes a "V" shape, with the tops of the "V" being suspended by the channel rods. The walls of the folder are angled away from vertical when the folder is full.

Likewise, the angled portions of the notches or hook ends are also angled away from vertical when the folder is full. For an overstuffed folder, which can contain substantially heavy contents, the angling of the walls away from vertical may be problematic. Specifically, the angled portion of the notches may generate a significant torque on the channel rods. When the folder is viewed from the side in its "V" shape, the angled portion of each notch directly adjacent to the folder wall may generate a torque that attempts to bend the center of each channel rod upward and inward, toward the center of the folder. For excessively heavy contents, and for significant separation between the channel rods when the folder is hanging, these torques may be sufficient to bend one or both channel rods, which could lead to structural failure of the folder.

Figure 9A:
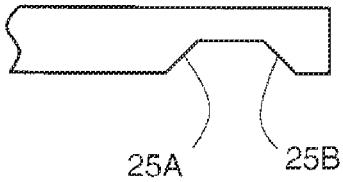
FIGS. 9 A, B, C and D are hook portions of the channel rod with portions broken away showing various alternate embodiments of FIGS. 1 and 8.
Figure 9B:
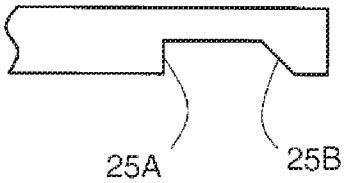
Figure 9C:
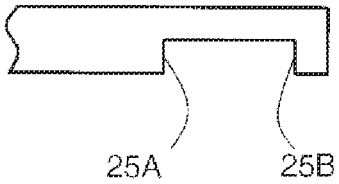
Figure 9D:
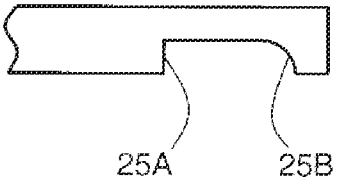

One way to avoid such potentially damaging torques when the folder is full is to eliminate the angled portions that are directly adjacent to the folder walls. In FIG. 8, the channel rods 124 have notches 25 on both lateral ends, but each notch 25 lacks an angled portion on the side directly adjacent to the folder wall. Specifically, the each channel rod 124 includes a general planar non-angled portion 130 directly adjacent to the folder wall which will contact the support rail (not shown) generally orthogonally thereto, though some rails are cylindrical. FIG. 9*a* shows the rail of FIG. 1 in a close up fragmentary view. FIGS. 9*b*, 9*c* and 9*d* show other preferred embodiments. Inner wall 25*b* is shown angled in FIG. 9*b*, orthogonal in FIG. 9*c* and arcuate in FIG. 9*d*. Orthogonal (right angle generally straight sidewalls) 25B with respect to the rod, is an unlikely design as it lacks the centering benefits of the angled wall in FIG. 9*a*, but it turns out that such centering benefit is offset by the detrimental torque effects. The arcuate (circular shape) in FIG. 9*d* may adds strength to the hook end. Thus the preferred embodiments of curved/arcuate or straight/orthogonal cut outs in the rod ends actually increase the strength of the folder by diminishing the twisting effects which occur when the rods are stressed to the point of bowing.

Figure 10:
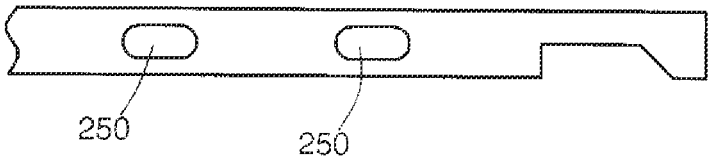
FIGS. 10 and 10A show recesses or grooves respectively, to portions of the channel rods.
Figure 10A:
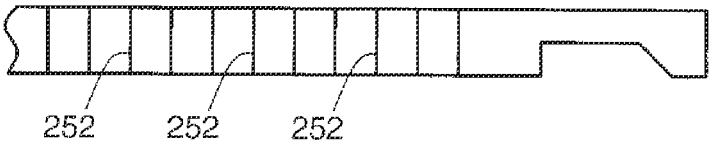

When the folder of FIGS. 8 and 10, 10A is full and hanging in the "V" shape, the non-angled portion/straight edge 130 does not generate any potentially damaging torque from contact with the rail but the angled portion does. Such an absence of torque may be beneficial to the folder, and may increase the strength of the folder for especially heavy and/or bulky contents.

Another issue with the rod and the retaining portion 23 is the separation of the two from each other due to forces beyond the limits of the adhesive which holds them together. Remember that it is only possible to glue/adhere the rod 24/124 to the folder on one side, i.e. the side which has no slots (the outside surfaces of the folder (front or back). They have not slots because they don't receive any tabs. Because they lack slots a glue line can be applied between the rod and the folder backing. If glue was applied to both sides of the rod it would likely ooze out of the slots or otherwise make them inoperative. This creates a dilemma in construction, i.e. how to strengthen the bond between the rod and folder without destroying the use of the slots.

The solution is found in increasing the surface area of the rod. This can be done by adding recesses to that portion of the rod which receives the adhesive. This is shown as recesses or apertures 250 in FIGS. 6 and 10. Such recesses are preferably punched or pressed into the rod during manufacture. The recesses are preferably located toward both ends of the rod (near the hooks) but not beyond the portion of the rod which is overcoated by the retaining portion 23 of the folder.

Beyond recesses, it is possible to achieve this beneficial effect by any means which increases the surface area of the rod and thus increases the uptake of adhesive. Other solutions include: a) holes such as shown in FIG. 10, b) cutting or pressing groves depressions into the rod surface (FIG. 10*a*, 252) so that it has effectively more adhesive contact area. The grooves can be longitudinal, transverse, diagonal, sinusoidal or any other pattern and can run the length of the rod or be restricted to portions close to the end of the retaining portion, and key problem is located; c) making the rod itself "wavey" is non-planar, so that it is in effect longer without lengthening the distance between the hook ends. Both of these solutions also provide alternatives to a channel 24*a* in rod 24 by providing a place for protrusion 15 to engage. Therefore a method of increasing the adhesion between the web 22 and the rod surfaces uses one or more of the above techniques to increase the surface area of the rod and then applying adhesive to the depressions (i.e. recesses, holes, grooves).

It is also helpful to coat the hook ends (portions shown in FIGS. 9 *a, b, c, d*) with a low friction coating, including power coating, at least on the contact surface which engages the rail, which makes them slide more easily along the support rails. Without a coating, the metal to metal (rail/rod) contact can cause the two to bond or hang up and increase torques.

Figure 11:
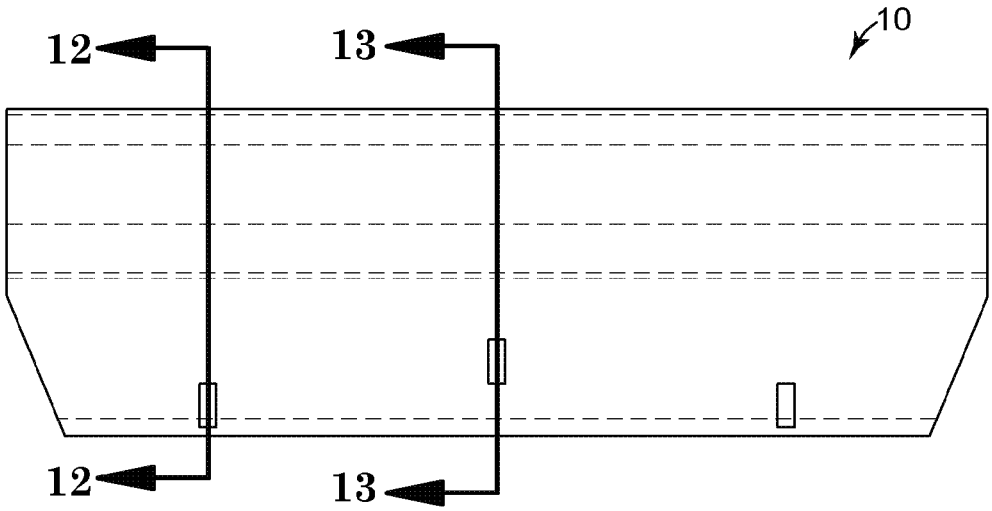
FIG. 11 is a plan view of tab.
Figure 12:
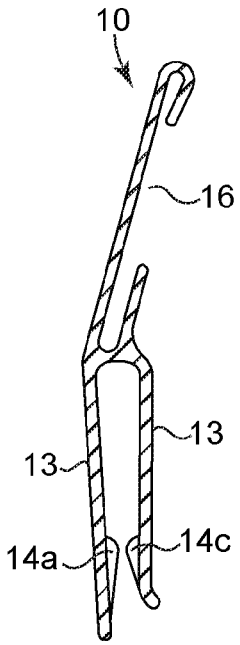
FIG. 12 is a profile view taken along lines 12-12 of FIG. 11.
Figure 13:
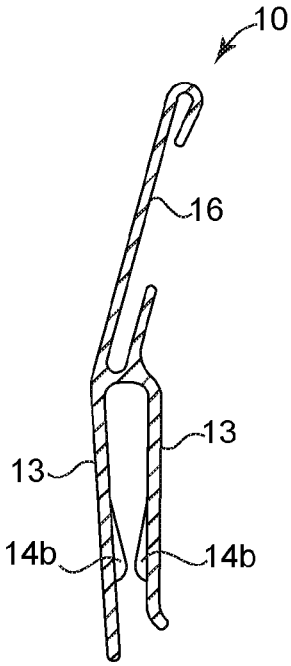
FIG. 13 is a profile view taken along lines 13-13 of FIG. 11.

FIGS. 11-13 show a tab with modified protrusions 14*a* and 14*b*. FIG. 12 shows protrusions similar to FIG. 3 with a bulbous portion at the upper end and declining toward the bottom or lower tip of the tab. The bulbous portion is in the form of a ramp having a relatively steep but curved up-ramp portion at its top end and a more gradual slope toward its lower end. FIG. 13 has the exact opposite slow with the bulbous end toward the lower bottom end of the tab and sloping more gradually toward its top.

Figure 14:
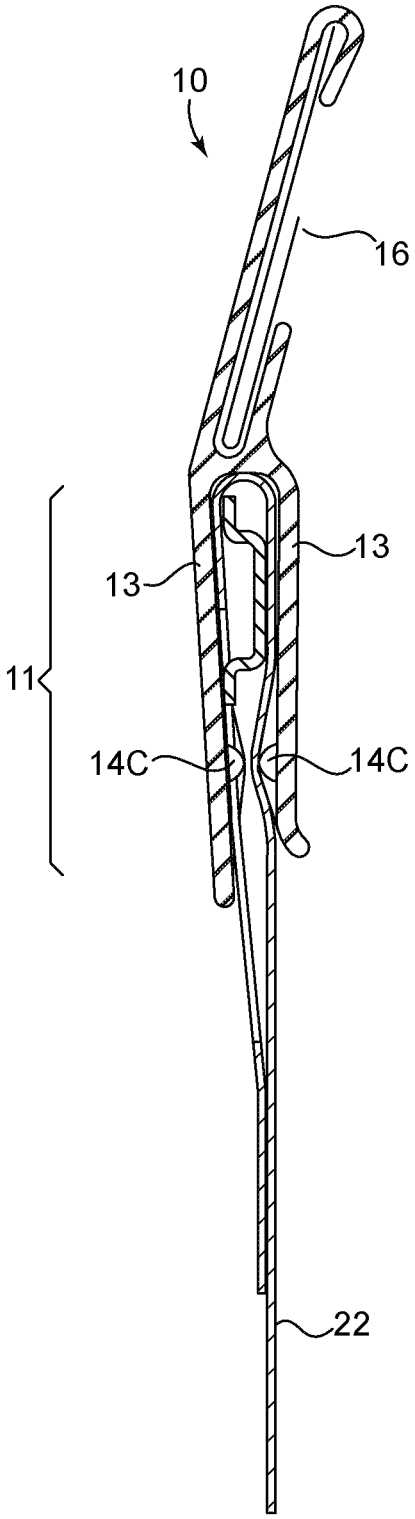
FIG. 14 is a side view of a tab installed on a hanging rod.

FIG. 14 illustrates a further embodiments where the protrusions 14*c* and generally hemispherical in shape having generally symmetric slopes. They may be round hemispherical dimples or longitudinal half-cylinders logs or "speed bump" shape extensions which run along the length of the tab where a larger area of engagement is desired. The cylinder/axial embodiment provide more surface compression than dimples, but the pressure applied per square millimeter may be likewise reduced.

Figure 15:
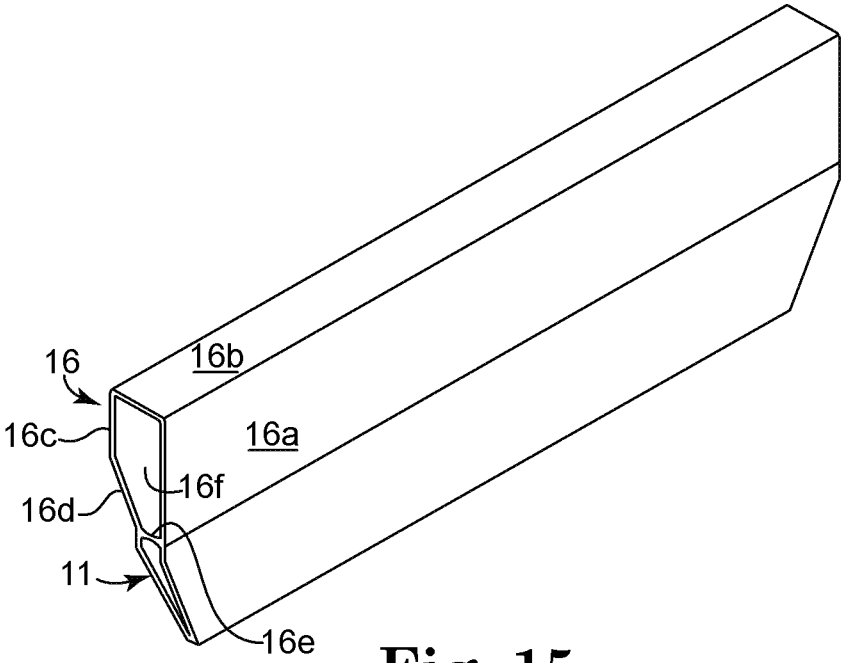
FIG. 15 is a perspective view of an alternate embodiment tab with a 3 dimensional profile.
Figure 16:
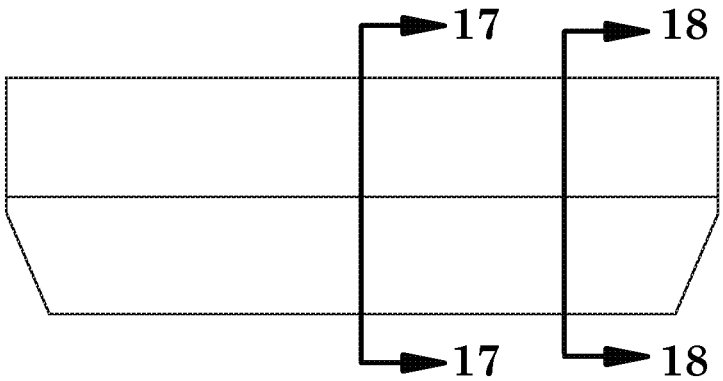
FIG. 16 is plan view of the 3-D tab of FIG. 15.

FIGS. 15, 16, 17 and 18 show an alternate 3-dimensional tab construction. In this embodiment, upper portion 16 includes a 3-D structure which can be various 3-D shapes such as that shown in FIGS. 15-18, but is not restricted thereto. In FIG. 15, upper portion includes sidewalls 16*a-e* wherein sidewall 16*e* forms part of clip portion 11 and sidewall 16*a* is orthogonal to 16*e*. Sidewall 16*d* extends from 16*e* at an oblique angle thereto and at its upper end if joined to sidewall 16*c* which is generally parallel to 16*a*. The two are joined by 16*b*, which is shown orthogonal to 16*a*, 16*c* but could be angled according to the viewers preference for viewing. A label can be overlayed onto portion 16 or, if 16 is transparent/translucent, may be inserted into the space 16*f* therein. This 3-D construction allows for labels with indicia, such as writing or printing, applied to multiple faces. In FIG. 15, the top an side faces can be so labeled. If sidewall 16*b* is angled by extending or reducing an adjacent sidewall, the labeling can display at that angle.

Figure 17:
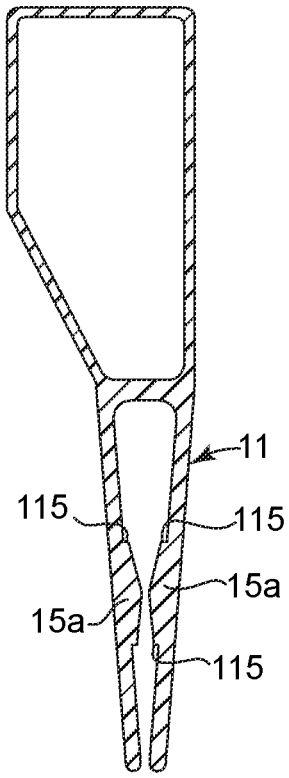
FIG. 17 is view taken along lines 17-17 of FIG. 16.
Figure 18:
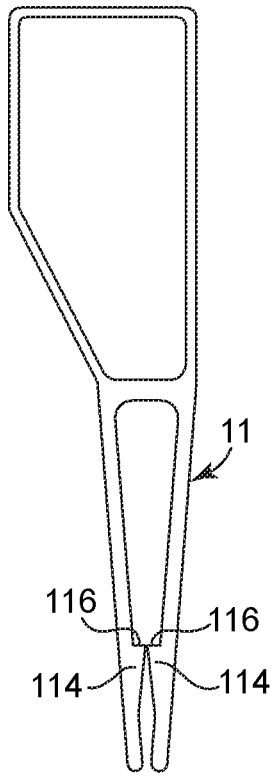
FIG. 18 is a view taken along lines 18-18 of FIG. 16.
Figure 19:
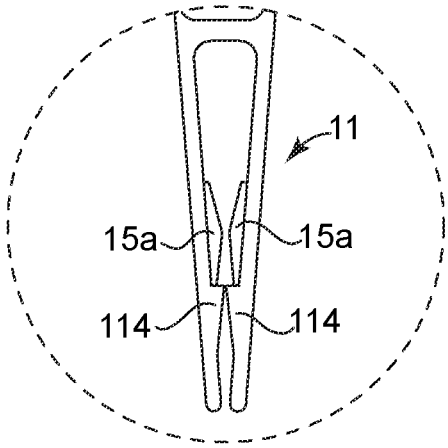
FIG. 19 is a side view of an alternate tab provided.

FIGS. 17, 18 and 19 illustrate the clip portion of the tab on a 3-D embodiment but can also be used on the previous embodiments.

In FIG. 17, the clip portion 11 differs from that shown in FIG. 4 where protrusions 15*a*, are opposing and have a hemispherical portion which joins a stepped or abrupt transition portion with a vertical sidewall 115. This sidewall helps maintain the protrusion within the rail (see FIG. 5) wherein the rail depression 24 with engage this step and prevent accidental removal.

FIG. 18 dispenses with protrusions 15 and depends on pair of opposing ramps 114 which terminate at their top (high) end with an orthogonal wall. This orthogonal wall engages the bottom end of the rail 24 (see FIG. 5.

FIG. 19 combines the elements of FIGS. 17 and 18 to obtain both effects.

The description of the invention and its applications as set forth herein is illustrative and is not intended to limit the scope of the invention. Variations and modifications of the embodiments disclosed herein are possible, and practical alternatives to and equivalents of the various elements of the embodiments would be understood to those of ordinary skill in the art upon study of this patent document. These and other variations and modifications of the embodiments disclosed herein may be made without departing from the scope and spirit of the invention.

We claim:

1. A file folder and slidable tab assembly for suspension in a filing unit with two spaced-apart suspension rails, said file folder assembly comprising:

a sheet folded along at least one medial line to define a folder having opposing walls extending upwardly from said at least one medial line, each wall having an upper edge and two side edges, each wall including a retaining portion at the upper edge thereof, each retaining portion surrounding a channel rod, each channel rod having a longitudinal surface with upper and lower edges therealong, each channel rod including notches at its lateral ends for engaging the spaced-apart suspension rails, each retaining portion including a plurality of vertically-oriented apertures facing the opposing wall, the apertures being spaced horizontally apart with a regular spacing, each vertically-oriented aperture extending at least from the lower edge of the channel rod and upwardly therefrom to expose at least a portion of the channel rod; and a repositionable tab attachable to the top of each retaining portion, each tab including a downward-opening clip portion, the clip portion having a top edge that contacts a top edge of the retaining portion when the tab is fully attached, the clip portion having two vertically-oriented inner faces that are on opposite sides of the retaining portion when the tab is fully attached, the two inner faces comprising a dimpled face that faces the apertures on the retaining portion when the tab is fully attached;

the dimpled face including at least first and second locking protrusions extending toward the retaining portion, the locking protrusions being spaced horizontally apart by an integral multiple of the aperture spacing on the retaining portion so that when the tab is attached to the folder, said protrusions will engage said apertures, the locking protrusions fitting at least partially within corresponding apertures in the retaining portion when the tab is attached, the locking protrusions engaging the channel rod when the tab is fully attached, a bias protrusion located between said first and second locking protrusions, spaced apart and above but not collinear therewith and located along said tab at a location where said bias protrusion is also aligned with an aperture and the surface of the rod, whereby the bias protrusion will apply a bias force between said rod and tab to maintain the position of the tab.

2. The file folder assembly of claim 1, wherein the locking protrusions engage the channel rod at its lower peripheral edge when the tab is fully attached and wherein said bias protrusion engages said channel rod on its longitudinal surface between its edges.

3. The file folder assembly of claim 1, wherein said surface of said channel rod includes a recess at least aligned with said bias projection when said tab is installed thereon and wherein said bias projection extends into said recess there by locking said tab to said channel rod at least three points.

4. The file folder assembly of claim 3, wherein the locating protrusion does not engage the recess of the channel rod when the tab is fully attached.

5. The file folder assembly of claim 3, wherein the dimpled face includes two locking protrusions spaced horizontally apart by twice the aperture spacing on the retaining portion; and wherein the bias protrusion is located halfway between the two locking protrusions but aligned with the apertures used by said locking protrusions.

6. The file folder assembly of claim 1, wherein the two inner faces further comprise an opposing dimpled face different from the dimpled face; and wherein each locking protrusion on the dimpled face has a corresponding laterally co-located locking protrusion on the opposing dimpled face.

7. A slidable repositionable tab attachable to a top edge of a hanging file folder, the folder having two opposing walls supported at their top edges by respective channel rods, the channel rods having upper and lower longitudinal edges and a surface therebetween, at least one wall having a plurality of vertically-oriented apertures adjacent its top edge facing the opposing wall, the apertures being spaced horizontally apart with a regular spacing and extending from at least the lower edge to the surface of the channel rod, the tab comprising:

a downward-opening clip portion, extending from said top portion, said clip portion having a top edge that contacts a top edge of a wall of the hanging file folder when the tab is fully attached, the clip portion having two vertically-oriented inner faces that are on opposite sides of the wall when the tab is fully attached, the two inner faces including a pair of first and second spaced apart collinear protrusions aligned to face each other and face the apertures on the wall when the tab is fully attached, the protrusions extending toward the wall, the protrusions being spaced horizontally apart by an integral multiple of the aperture spacing on the wall, the protrusions fitting at least partially within corresponding apertures on the wall when the tab is attached, the protrusions engaging the lower edge of the channel rod when the tab is fully attached;

a third bias protrusion located between said first and second protrusions, and above and not collinear therewith, the third protrusion located relative to said first and second protrusions to engage the surface of said rod between its peripheral edges, when the tab is fully attached; whereby the third protrusion will apply a bias force between said rod and tab to maintain the position of the tab.

8. The tab according to claim 7 wherein said surface of said rod includes a recess and wherein said third protrusion projects into said recess.

9. The tab according to claim 7 wherein said surface of said rod includes a plurality of recessed spaced along the rod and wherein said third protrusion projects into said recess.

10. The tab according to claim 7 wherein said surface of said rod includes a longitudinal channel recess and wherein said third protrusion projects into said channel.

* * * * *